United States Patent [19]

Kasai

[11] Patent Number: 4,888,858

[45] Date of Patent: Dec. 26, 1989

[54] BUCKLE ASSEMBLY

[75] Inventor: Kazumi Kasai, Namerikawa, Japan

[73] Assignee: Yoshida Kogyo K.K., Tokyo, Japan

[21] Appl. No.: 365,685

[22] Filed: Jun. 14, 1989

[30] Foreign Application Priority Data

Jun. 17, 1988 [JP] Japan ..... 63-80433[U]

[51] Int. Cl.[4] ..... A44B 11/14

[52] U.S. Cl. ..... 24/163 R; 24/170

[58] Field of Search ..... 24/163 R, 170, 165, 24/184, 191, 68 R, 68 CD, 584, 585, 643, 662, 324, 487, 265 BC, 265 EC, 313, 311, 30.5 R, 633; 297/484

[56] References Cited

U.S. PATENT DOCUMENTS

| | | | |
|---|---|---|---|
| 4,604,772 | 8/1986 | Arff | 24/170 |
| 4,674,155 | 6/1987 | Turtle et al. | 24/191 |
| 4,727,630 | 3/1988 | Alan | 24/585 |
| 4,815,175 | 3/1989 | Kasai | 24/311 |

*Primary Examiner*—Victor N. Sakran

*Attorney, Agent, or Firm*—Hill, Van Santen, Steadman & Simpson

[57] ABSTRACT

A buckle comprises a male member having a tongue-shaped presser having on its bottom side a pair of engaging legs each having on its inner side a stepped portion and a female member in the form of a case having in its top wall a central aperture, the female member having a pair of resilient arms, one mounted on each side thereof, each resilient arm extending from one end of the female member and terminating in a free end portion for resilient angular movement about its proximal end, each free end portion having on its inner side a hook-shaped engaging means adapted for engagement with the stepped portion of the corresponding engaging leg when the engaging legs are forced into the central aperture. The tongue-shaped presser further has on its bottom side a pair of resilient pieces. The free end portions further have on their respective inner sides abutment portions adapted to compress the distal portions of the resilient pieces against the resiliency thereof as the resilient arms are angularly moved in the direction to bring the hook-shaped engaging means out of engagement with the stepped portion of the engaging legs.

2 Claims, 4 Drawing Sheets

BUCKLE ASSEMBLY

BACKGROUND OF THE INVENTION

1. Field of the Invention:

The present invention relates to a buckle for fastening a closure flap of a bag, a rucksack or the like, and also for fastening straps, belts or suspenders of a shoe, a boot, trousers, a skirt or the like.

2. Description of the Prior Art:

Japanese Utility Model Laid-Open Publication No. 60-31809 discloses a buckle for fastening belts of shoe which buckle comprises, as shown in FIGS. 4A, 4B and 4C of the accompanying drawings, interlocking male and female members A, B. The male member A has on its bottom surface a pair of resilient legs C, C, each having on its outer side a stepped portion which is engageable with the edge D of an aperture in the female member B as the male member A is pressed against the female member B so as to force the legs C, C into the aperture from the to side of the female member B in a snap action. The female member B has a pair of resilient arms E, E having a pair of inwardly directed pushing portions F, F. When the two arms E, E are pressed toward each other, the pusher portion F, F pushes the legs C, C so as to resiliently bend the same inwardly, thereby bringing the stepped portions out of engagement with the edge D of the aperture, so that the male member A is uncoupled from the female member B. The female member B further has a hollow chamber H formed therein and a cantilever resilient member G supported on the left side and on the bottom surface (as viewed in FIG. 4C) of the female member B and extending into the hollow chamber H so as to normally urge at its distal end K the bottom surface of the male member A upwardly, so that, when the male member A is uncoupled from the female member B, the male member A springs up under the resiliency of the cantilever resilient member G.

However, such a conventional buckle is disadvantageous in that, since the cantilever resilient member G of the female member B continues to urge the bottom surface of the male member A throughout while the male member A is coupled with the female member B, the cantilever resilient member G is liable to fatigue, namely, has a tendency to lose resiliecy so that the the buckle as a whole lacks in durability. Furthermore, the cantilever resilient member is formed in such a shape to extend into the hollow chamber H, it is not simple to manufacture.

SUMMARY OF THE INVENTION

With the drawbacks in view, it is an object of the present invention to provide a backle having resilient means for springing the male member apart from the female member the moment the former is uncoupled from the latter, the resilient means being simple in construction, thus easy to form and capable of maintaining resiliency despite of long use, so that the buckle as a whole is easy to manufacture and wears well for a prolonged period of time.

According to the present invention, there is provided a buckle comprising: a male member having a tongue-shaped presser having on its bottom side a pair of engaging legs each having on its inner side a stepped portion; a female member in the form of a case having in its top wall a central aperture for insertion of the engaging legs thereinto, the female member having a pair of resilient arms mounted, one on each side thereof, each resilient arm extending from one end of the female member and terminating in a free end portion for resilient angular movement about its proximal end, each free end portion having on its inner side a hook-shaped engaging means adapted for engagement with the stepped portion of the engaging legs when the engaging legs are inserted into the central aperture; and the tongue-shaped presser further having on its bottom side a pair of resilient pieces, the free end portions further having on their respective inner sides abutment portions adapted to compress the distal portions of the resilient pieces against the resiliency thereof as the resilient arms are angularly moved in the direction to bring the hook-shaped engaging means out of engagement with the stepped portion of the engaging legs.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 3A:
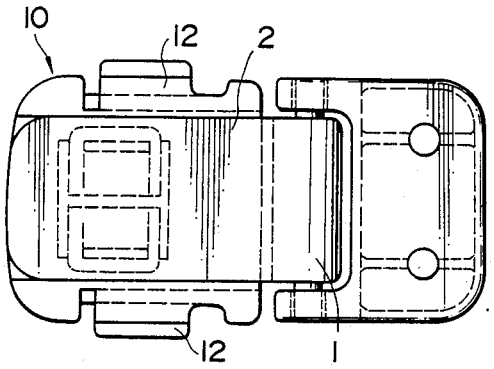
FIG. 3A is a plan view of the buckle, showing the male and female members in a coupled posture.
Figure 3B:
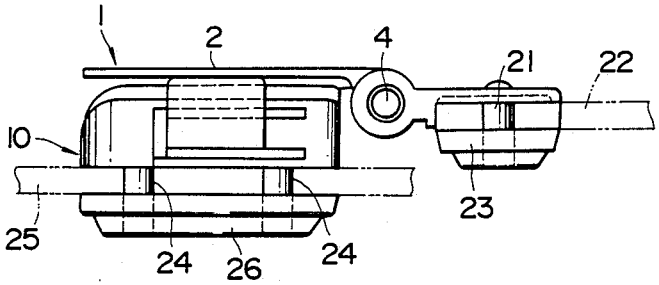
FIG. 3B is a side elevational view of FIG. 3A.
Figure 3C:
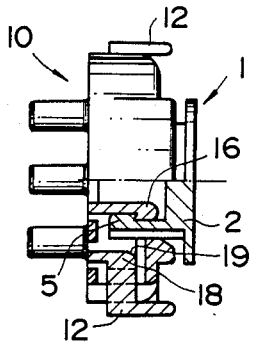
FIG. 3C is a rear elevational view, partly in cross section, of FIG. 3A.
Figure 4A:
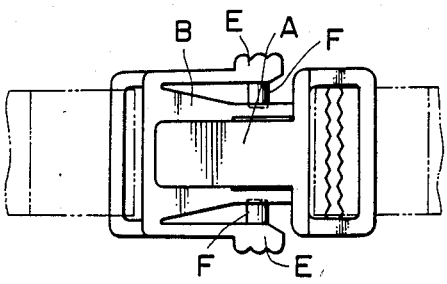
FIG. 4A (PRIOR ART)
FIG. 4A is a plan view of a buckle according to a prior art, showing male and female members in a coupled posture.
Figure 4B:
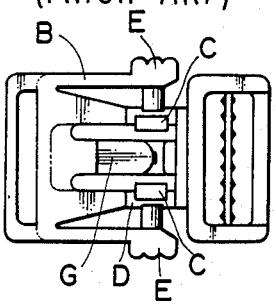
FIG. 4B (PRIOR ART)
FIG. 4B is a bottom view of FIG. 4A.
Figure 4C:
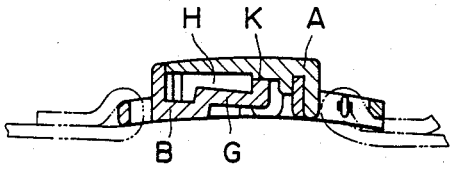
FIG. 4C (PRIOR ART)
FIG. 4C is a longitudinal cross-sectional view of FIG. 4A.

The principle of the present invention is particularly useful when embodied in a buckle such as shown in FIGS. 3A through 3C.

The buckle comprises a male member 1 (FIGS. 1A through 1D) and a female member 10 (FIGS. 2A through 2E). Each of the male and female members 1, 10 is molded of a synthetic resin such as polyacetal, nylon or polypropylene.

As shown in FIGS. 1A through 1D, the male member 1 includes an attachment plate 3 and a tongue-shaped presser 2 pivotally mounted on the attachment plate 3 by means of a pair of aligned pins 4, 4 provided on one end of and on the opposite sides of the tongue-shaped presser 2.

The tongue-shaped presser 2 has on its bottom side a pair of engaging legs 5, 5 and a pair of resilient pieces 6, 6, all integrally formed on the tongue-shaped presser 2. As better shown in FIG. 1, the two engaging legs 5, 5 are separated, laterally of the tongue-shaped presser 2, from each other; while the two resilient pieces 6, 6 are, similarly, separated, laterally of the tongue-shaped presser 2, from each other. The two resilient pieces 6, 6 are disposed adjacent to and extend parallel to the two engaging legs 5, 5, respectively, longitudinally of the tongue-shaped presser 2. As better shown in FIG. 1D, each of the engaging legs 5, 5 has at its top a beveled surface 7 and at the middle on its inner or opposed side, a stepped portion 8.

Figure 1A:
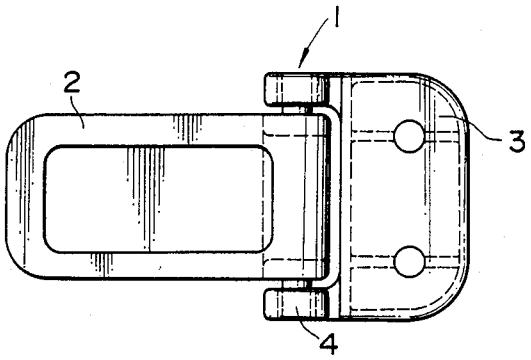
FIG. 1A is a plan view of a male member of a buckle embodying the present invention.
Figure 1B:
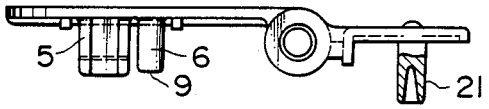
FIG. 1B is a side elevational view, partly in cross section of FIG. 1A.
Figure 1C:
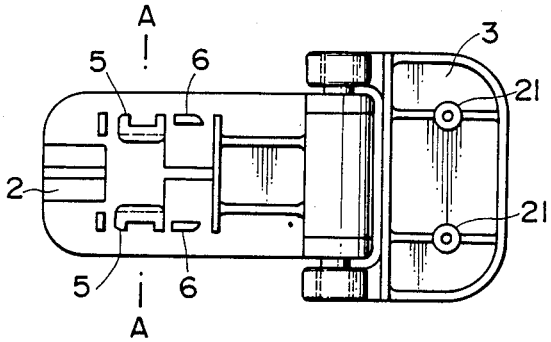
FIG. 1C is a bottom view of FIG. 1A.
Figure 1D:
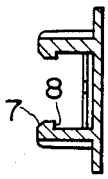
FIG. 1D is a cross sectional view taken on line A-A of FIG. 1C.

As shown in FIGS. 1B and 1C, the attachment plate 3 is provided at its bottom side with a pair of studs 21, 21. As better shown in FIG. 3B, the studs 21, 21 pass through a strap, a belt, a suspender or the like (hereinafter referred to as strap) 22 first and then are secured at their distal ends to a base plate 23, so that the male member 1 is firmly attached to the strap 22.

Figure 2A:
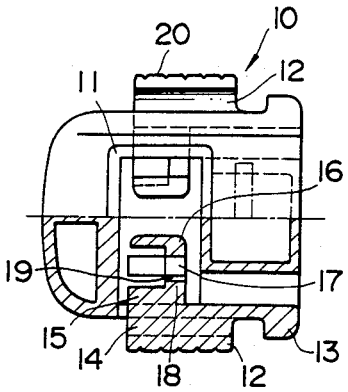
FIG. 2A is a plan view, partly in cross section, of a female member of the buckle.
Figure 2B:
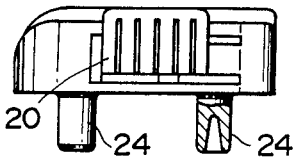
FIG. 2B is a side elevational view, partly in cross section, of FIG. 2A.
Figure 2C:
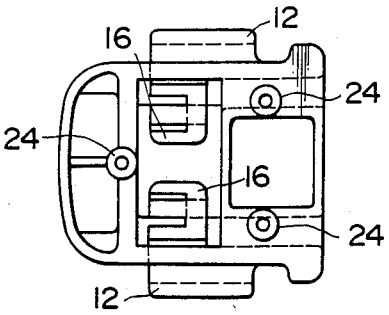
FIG. 2C is a bottom view of FIG. 2A.
Figure 2D:
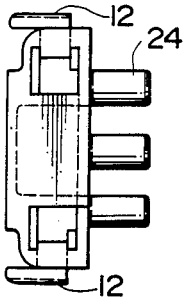
FIG. 2D is a front elevational view of FIG. 2A.
Figure 2E:
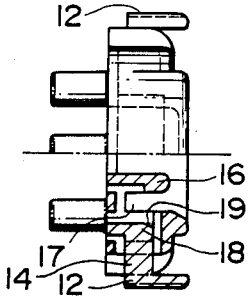
FIG. 2E is a rear elevational view, partly in cross section, of FIG. 2A.

As shown in FIG. 2A through 2E, the female member 10 is generally in the form of a case having in its top wall a central aperture 11 into which the two engaging legs 5, 5 and the two resilient pieces 6, 6 of the male member 1 is adapted to be inserted. The female member 10 also has a pair of resilient arms 12, 12 mounted, one on each of the opposed sides thereof. Each resilient arm 12 is integrally formed with and extends lengthwise from one end (right end as viewed in FIGS. 2A through 2C) of the female member 10 and terminate in a free end portion 14 so that the resilient arms 12, 12 are angularly movable about the respective proximal ends 13, 13 in resilient manner towards and away from each other. The free end portion 14 has at its inner side an extension 15 which is directed inwardly of the female member 10. The extension 15 has at its distal end a hook-shaped engaging means 16 adapted for snap engagement with the stepped portion 8 of the engaging leg 5 of the male member 1 when the engaging legs 5 are forced into the central aperture 11 of the female member 10. As better shown in FIGS. 2A and 2E, there is defined by and between the outer side of the hook-shaped engaging means 16 and the opposite side or the inner side of of the free end portion 14 of the resilient arm 12 a space 17 adapted to receive the corresponding one of the engaging legs 5, 5 and the corresponding one of the resilient pieces 6, 6 when the engaging legs 5, 5 and the resilient pieces 6, 6 are forced into the central aperture 11 of the female member 10. Each free end portion 14 has on its inner side a protuberant abutment portion 18 which faces the outer side of the hook-shaped engaging means 16. The abutment portions 18, 18 are adapted to compress the distal portions 9, 9 of the respective resilient pieces 6, 6 against the resiliency thereof when the resilient arms 12, 12 are angularly moved towards each other, thus exerting force tending to move the tongue-shaped presser 2 upwardly, thereby snappingly uncoupling the tongue-shaped presser 2 of the male member 1 from the female member 10. As better shown in FIG. 2E, each abutment portion 18 may have at its distal end a slant surface 19 facing obliquely upwardly so as to more effectively exert forces tending to move the tongue-shaped presser 2 upwardly. Each resilient arm 12 has on its outer side a grip plate 20 which extends perpendicularly to the resilient arm 12. As shown in FIGS. 2B and 2C, the female member 10 has on its bottom side three studs 24, 24, 24 which, as shown in FIG. 3B, pass through the strap 25 first and are fastened at their distal ends to a base plate 26 for firm attachment of the strap 25 to the female member 10. Coupling and uncoupling operation of the male member 1 and female member 10 is now described hereinbelow.

For coupling the male member 1 with the female member 10, the tongue-shaped presser 2 of the male member 1 is caused to pivot on the pins into pressing engagement with the female member 10, thereby forcing the engaging legs 5, 5 and the resilient pieces 6, 6 of the former into the central aperture 11 of the latter. The engaging legs 5, 5 are forced against the hook-shaped engaging means 16, 16 as the former compress the latter against the resiliency of the resilient arms 12, 12 until the stepped portions 8, 8 come into snapping engagement with the hook-shaped engaging means 16, 16 of the female member 10. FIGS. 3A through 3C shows the male member 1 and the female member 10 which have been resultantly coupled with each other. FIG. 3B shows that the male member 1 and the female member 10 are attached to the respective straps 22, 25, so that the male member 1 and the female member 10 being coupled together has given rise to the respective straps 22, 25 being joined with each other.

For uncoupling the male member 1 from the female member 10, the grip plates 20, 20 of the resilient arms 12, 12 are compressed by fingers of a wearer. As a result, the resilient arms 12, 12 angularly move about their proximal ends 13, 13 against their own resiliency so as to move their free end portions 14, 14 towards each other until the hook-shaped engaging means 16, 16 provided on the extension 15, 15 of the free end portion 14, 14 come out of engagement with the stepped portions 8, 8 of the engaging legs 5, 5, of the tongue-shaped presser 2. At the moment that the hook-shaped engaging means 16, 16 come out of engagement with the respective stepped portions 8, 8, the abutment portions 18, 18 compress the resilient pieces 6, 6 against the resiliency thereof, so that, eventually, the tongue-shaped presser 2 of the male member 1 springs apart from female member 10 automatically in a snap action under the resiliency of the resilient pieces 6, 6.

Release of fingers from the grip plates 20, 20 would cause the resilient arms 12, 12 spring back under their own resiliency whereby the hook-shaped engaging means 16, 16 and the abutment portions 18, 18 are restored into their respective original positions so that the female member 10 is just ready for next coupling with the male member 1.

With the construction of the buckle according to the present invention described hereinabove, the following advantages are accomplished.

As soon as uncoupled from the female member, the tongue-shaped presser of the male member automatically spring apart from the female member, so that the separation of the male and female members can be carried out by a single movement of just compressing the grip plates. This advantageously dispenses with an additional work of manually separating the tongue-shaped presser of the male member apart from the female member.

Furthermore, the resilient pieces are bent or are subjected to deformation by the abutment portion only when the grip plates are compressed to uncouple the male and female member, so that the resilient pieces can maintain their resiliency and hence the buckles as a whole can wear for a prolonged period of time.

Still furthermore, the resilient pieces for springing apart the male member from the female member is of such simple construction as to just stand upright on the flat bottom side of the tongue-shaped presser, so that the resilient pieces are easier to form, and hence the buckle as a whole are easier to manufacture.

Obviously, various modifications and variations of the present invention are possible in the light of the above teaching. It is therefore to be understood that within the scope of the appended claims the invention ma be practiced otherwise than as specifically described.

What is claimed is:

1. A buckle comprising: a male member having a tongue-shaped presser having on its bottom side a pair of engaging legs each having on its inner side a stepped portion; a female member in the form of a case having in its top wall a central aperture for insertion of the engaging legs thereinto, the female member having a pair of resilient arms, one mounted on each side thereof, each resilient arm extending from one end of the female member and terminating in a free end portion for resilient angular movement about its proximal end, each free end portion having on its inner side a hook-shaped engaging means adapted for engagement with the stepped portion of the corresponding engaging leg when the engaging legs are inserted into the central aperture; and the tongue-shaped presser further having on its bottom side a pair of resilient pieces, the free end portions further having on their respective inner sides abutment portions adapted to compress the distal portions of the resilient pieces against the resiliency thereof as the resilient arms are angularly moved in the direction to bring the hook-shaped engaging means out of engagement with the stepped portions of the engaging legs.

2. A buckle according to claim 1, wherein each of the abutment portions has at its distal end a slant surface facing obliquely upwardly.

* * * * *